US005680665A

United States Patent [19]

Anson et al.

[11] Patent Number: 5,680,665

[45] Date of Patent: Oct. 28, 1997

[54] BALL CONDITIONING, SORTING AND COLLECTING APPARATUS FOR CIRCULATING BALL CLEANING SYSTEM

[75] Inventors: Dean Anson, Greendale; Dennis P. Tronca; James E. Biersach, both of Mequon, all of Wis.

[73] Assignee: Water Services of America, Inc., West Allis, Wis.

[21] Appl. No.: 639,039

[22] Filed: Apr. 16, 1996

[51] Int. Cl.[6] ..... B08B 9/04; F28G 1/12

[52] U.S. Cl. ..... 15/3.51; 165/95; 209/670

[58] Field of Search ..... 15/3.5, 3.51; 165/95; 209/670, 673

[56] References Cited

U.S. PATENT DOCUMENTS

| | | | |
|---|---|---|---|
| 3,919,732 | 11/1975 | Honma et al. . | |
| 4,314,604 | 2/1982 | Koller . | |
| 4,351,387 | 9/1982 | Milia . | |
| 4,420,038 | 12/1983 | Okouchi et al. . | |
| 4,435,285 | 3/1984 | Okouchi et al. . | |
| 4,569,097 | 2/1986 | Echols . | |
| 4,865,121 | 9/1989 | Ben-Dosa | 15/3.5 |
| 4,974,662 | 12/1990 | Bizard . | |
| 4,984,629 | 1/1991 | Voith et al. . | |
| 5,010,950 | 4/1991 | Voith . | |
| 5,086,833 | 2/1992 | Ben-Dosa . | |
| 5,176,204 | 1/1993 | Ben-Dosa . | |
| 5,411,152 | 5/1995 | Matthews | 209/670 |
| 5,433,229 | 7/1995 | Blair | 15/3.51 |

FOREIGN PATENT DOCUMENTS

| | | | |
|---|---|---|---|
| 631639 | 8/1963 | Belgium | 209/670 |

*Primary Examiner*—David Scherbel
*Assistant Examiner*—Randall Chin
*Attorney, Agent, or Firm*—Andrus, Sceales, Starke & Sawall

[57] ABSTRACT

An apparatus for selectively recirculating, conditioning, sorting and collecting the balls and discharging the balls from a pipe cleaning system utilizing recirculating foam rubber balls includes a housing having a dividing wall defining an inlet chamber on one side thereof and a collection chamber on the other side thereof, the inlet chamber having an inlet and the collection chamber having an outlet. A movable plate further divides the collection chamber into a acceptable ball chamber and a rejected ball chamber. A roller arrangement is operably connected with the housing and cooperates with the movable plate to condition and sort the balls in the system into the rejected ball chamber and the acceptable ball chamber. The collection chamber has a movable screen which selectively controls the flow of balls from the acceptable ball chamber to the outlet.

20 Claims, 4 Drawing Sheets

74

30
36
26
72
76
76
78
36a
6
40
62
4
37
48
46
42
66
75
8
8
74
70
32
92
4
88
24
23
33b
33a
33
80
6
34a
27
25
34

BALL CONDITIONING, SORTING AND COLLECTING APPARATUS FOR CIRCULATING BALL CLEANING SYSTEM

FIELD OF THE INVENTION

The present invention pertains to a system utilizing recirculating, porous foam rubber balls as a tube cleaning media and, more particularly, to an apparatus for collecting and removing balls from the system and for adding new balls to the system.

BACKGROUND OF THE INVENTION

It is well known in the art to provide the condenser and a heat exchanger with a large number of parallel tubes through which cooling water is directed. The condenser tubes are supplied with cooling water by a pump-operated recirculating system, typically receiving water from a cooling tower, circulating it through the heat exchanger condenser and returning it to the cooling tower.

Various methods are utilized for periodically cleaning the condenser tubes to remove deposits which accumulate therein. Typically, the condenser tubes may be about one inch in diameter and, in one known method, resilient foam rubber balls having a diameter slightly larger than the tubes are circulated therethrough with the cooling water. The balls are compressed slightly as they enter the tubes and are forced through the tubes by water pressure carrying accumulated deposits with them. The balls are injected into the cooling water flow from a parallel branch upstream from the condenser and are removed from the stream after they exit the condenser and diverted from the main cooling water flow back into the parallel branch for recirculation or collection. To separate the balls from the return flow to the cooling tower, a ball strainer comprising a large screen is disposed in the return flow piping system where the balls are screened from the flow and diverted into the collection/recirculation branch.

Balls which are diverted from the main cooling water stream by the ball strainer and shunted into the parallel recirculation branch are delivered to a ball collector apparatus which, in typical prior art systems, may be operated to allow the balls to flow directly therethrough for recirculation, to collect and hold the balls while allowing only the water to continue through the collector, or to discharge the balls from the system. The porous, foam rubber balls used in these systems may have diameters in the range typically less than one and one-half inches (just slightly larger than the condenser tubes through which they are forced to pass). Abrasive wear on the balls eventually reduces their diameter and requires them to be replaced. Thus, a ball collector apparatus also typically provides a means for adding new balls to the system to replace those discharged after collection.

One common prior art ball collector apparatus is disclosed in U.S. Pat. No. 4,984,629 issued to Voith, et al on Jan. 15, 1991 and assigned to the assignee of this application. In that patent, the collecting apparatus includes a housing having a cylindrical outer wall and opposite end walls, the end walls supporting an internal screen within the housing for rotation on the axis of the cylindrical outer wall. The housing includes a flow inlet, a flow outlet, and a ball retaining screen is selectively rotatable between a ball recirculating position with the flow inlet and flow outlet disposed on the ball retaining side of the screen, a ball collecting and holding position with the flow inlet disposed on the ball retaining side of the screen, and the ball discharging position with the ball outlet disposed on the ball retaining side of the screen. Each of the flow inlet, flow outlet and ball outlet are provided with flow control means for controlling the flow through the housing and for inspecting discharge of the ball outlet.

The collector housing also includes a ball filling inlet in the upper portion thereof, preferably above the flow inlet and flow outlet. Access to the interior of the housing via the filling inlet is provided by a removable cover. By filling the housing with dry balls and attaching a source of vacuum to the housing above a selected water level, the balls may be de-aerated in situ and immediately placed in service.

While the aforedescribed ball collecting apparatus has generally been satisfactory, it remains desirable to provide an improved ball collection system which enables the selective sortation of acceptable and rejected balls in the system and combines an enhanced, internal conditioning structure which will more efficiently de-aerate balls while the flow of water through the housing continues. It is also desirable to provide an improved ball collecting system wherein new and different types of balls are able to be added in different portions of the system. Further, it is desirable to be able to drain both acceptable and rejected balls from the system and permit an effective entry of acceptable balls back into the system.

SUMMARY OF THE INVENTION

This invention advantageously provides an improved ball collection apparatus for a pipe cleaning system in which balls recirculated in the system may be conditioned by squeezably de-aerating the balls, sorted between acceptable balls and rejected (damaged, worn) balls, and controllably held for selective discharge back into the system.

In one aspect of the invention, an apparatus for selectively recirculating, conditioning, sorting and collecting the balls and discharging balls from a pipe cleaning system wherein porous, resilient foam rubber balls are circulated in the flow of water through pipes to be cleaned comprises a housing divided into an inlet chamber for introducing balls from the system and a collection chamber downstream of the inlet chamber. A ball conditioning and sorting arrangement is operably connected with the housing for de-aerating the balls from the inlet chamber and selectively classifying the de-aerated balls within the collection chamber. A valve means is provided in the collection chamber for permitting the continuous flow of water therethrough and selectively controlling the discharge of balls from the collection chamber into the system.

In another aspect of the invention, an apparatus for selectively recirculating, conditioning, sorting and collecting the balls and discharging the balls from a pipe cleaning system wherein porous, resilient foam rubber balls are circulated in a flow of water through pipes to be cleaned comprises a housing having a dividing wall defining an inlet chamber on one side thereof and a collection chamber on the other side thereof, the inlet chamber having an inlet and the collection chamber having an outlet. A movable plate further divides the collection chamber into a rejected ball chamber and a acceptable ball chamber. A roller arrangement is operably connected with the housing and cooperates with the movable plate to condition and sort the balls in the system into the rejected ball chamber and the acceptable ball chamber. The collection chamber has a movable screen which selectively controls the flow of balls from the acceptable ball chamber to the outlet.

BRIEF DESCRIPTION OF THE DRAWINGS

The invention will become better understood by reference to the following detailed description of the preferred exemplary embodiment when read in conjunction with the appended drawing wherein like numerals denote like elements.

DETAILED DESCRIPTION OF THE PREFERRED EMBODIMENT

Figure 1:
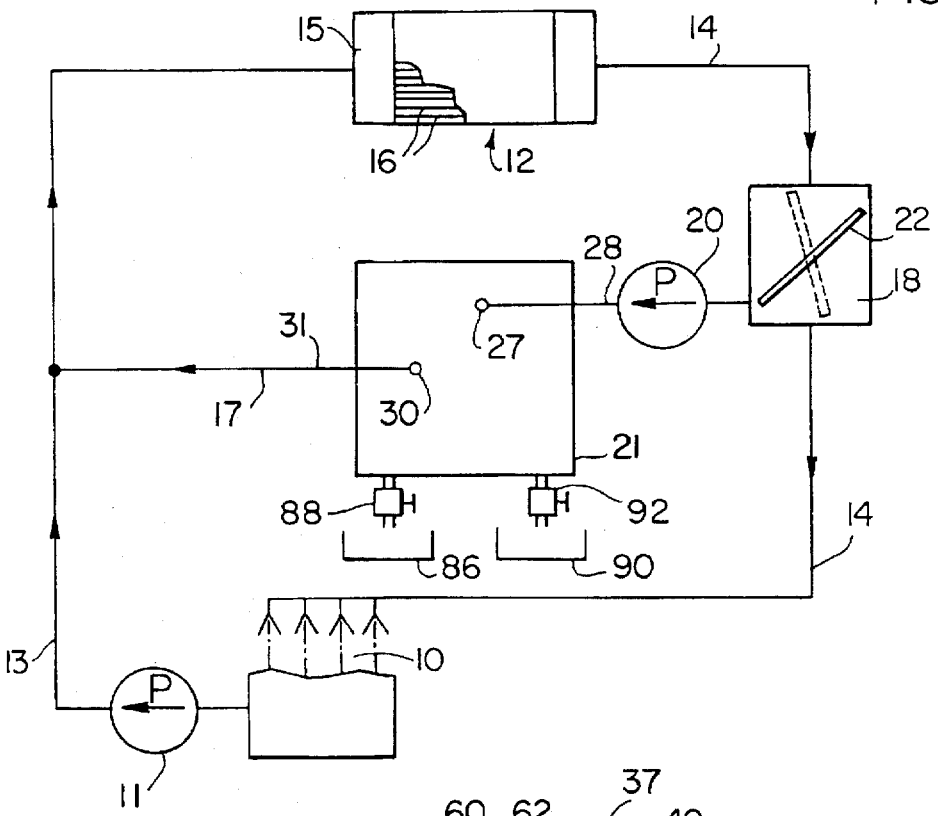
FIG. 1 is a schematic representation of a pipe cleaning system including the ball conditioning and sorting apparatus embodying the present invention.
Figure 2:
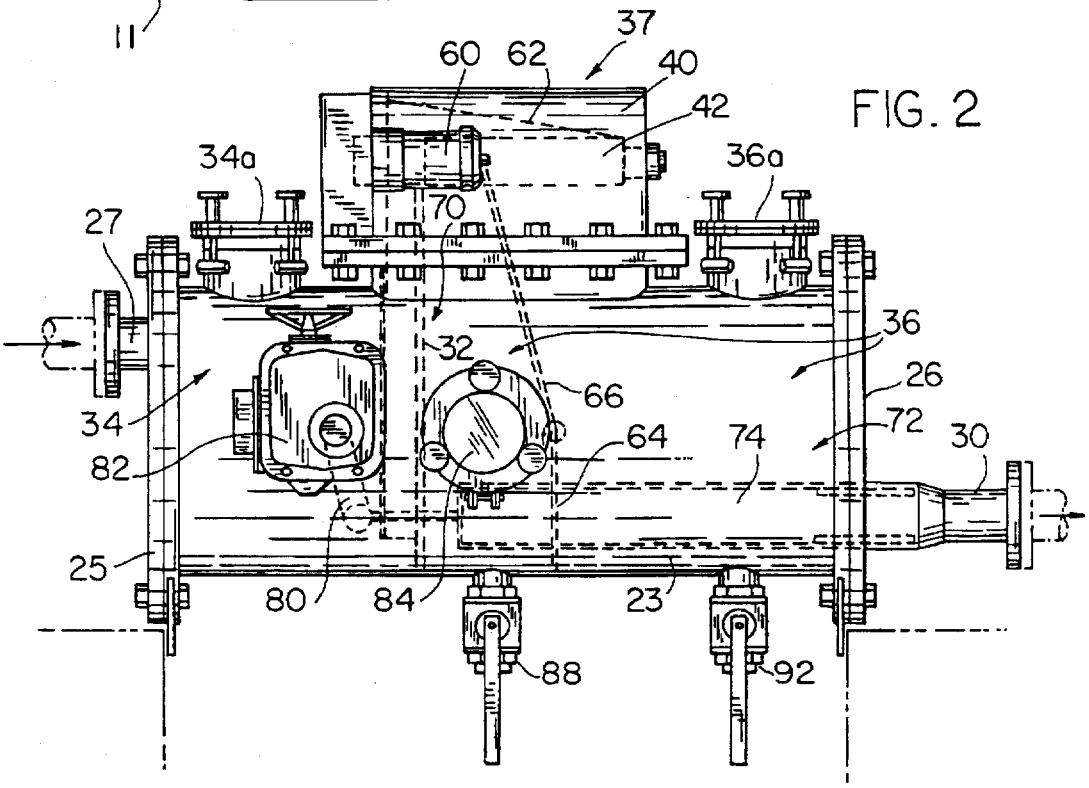
FIG. 2 is an enlarged elevational view of the ball conditioning and sorting apparatus shown in FIG. 1.

Referring initially to FIG. 1, a typical cooling water circulation system receives a supply of cooling water from a cooling tower 10 which is circulated by a pump 11 via means supply pipe 13 through heat exchanger 12 and back to the cooling tower via a main return pipe 14. Heat exchanger includes a condenser 15 comprising a large number of small tubes 16 through which the cooling water flows.

Periodically, the tubes 16 of the condenser must be cleaned of deposits which accumulate therein. In the system shown, a large number of foam rubber balls of a diameter slightly larger than the tube 16 are circulated with the cooling water through the condenser where the balls randomly are forced by system pressure through the tubes where they strip deposits from the tube walls. The balls are confined to flow through the condenser by a parallel branch pipe 17 disposed between the main supply line 13 and return line 14. Balls exiting the condenser 15 are taken out of the main cooling water flow by a ball strainer 18 which diverts the balls into the branch pipe 17 under the influence of a ball circulating pump 20. Branch pipe 17 is just large enough to easily accommodate the movement of balls therethrough and, therefore, does not divert a significant volume of cooling water from the main return line 14. For example, the main cooling water lines may be several feet or larger in diameter. The condenser tube 16 may be typically less than one and one-half inches in diameter. The cleaning balls are slightly larger in diameter. The ball recirculating branch pipe 17 may, correspondingly, range in size of two and one-half inches to three inches. The foregoing sizes are merely exemplary and all of them may vary substantially.

The cleaning balls are not continuously circulated through the heat exchanger and, therefore, provision must be made to periodically collect the balls which are initially removed from the main line by the ball strainer 18. A ball collector 21 is disposed in the branch pipe line 17 and, in a fully open position, simply allows the cleaning balls to pass straight through for recirculation. The ball collector 21 also typically includes conditioning, sorting, and collecting positions in which a pair of movable screens are operated to strain the balls from the circulating water flow through the branch pipe 17. The balls are typically conditioned, sorted and collected and held such that the screen 22 in the ball strainer may be rotated from its full line ball straining position in FIG. 1 to the dotted line backwash position such that the cooling water flow through the strainer will clean the screen 22 of accumulated debris and the like. The ball collector 21 also typically includes a ball drain valve position, such that cleaning balls which have become worn or damaged to the point that they are undersized or otherwise affected can be removed from the system and replaced.

Referring now to FIGS. 2–7, the ball collector apparatus 21 of the present invention is operable to provide several important functions in the overall system shown in FIG. 1. First of all, the collector includes an extreme operating position in which the balls are allowed to flow directly therethrough for recirculation. Ball collector is also operated to condition the balls by squeezing them, to sort the balls into acceptable balls and rejected balls, and to collect and hold the balls in an acceptable ball chamber and a rejected ball chamber, while the ball strainer screen 22 is being backwashed. Finally, the collector is operated to remove acceptable or rejected balls completely from the system, to replace them with new or different type balls and to reintroduce acceptable balls back into the system.

The ball collector 21 includes a housing comprising a cylindrical outer wall 24 and opposite end walls 25 and 26. End wall 25 includes a flow inlet 27 in fluid communication with the upstream section 28 of parallel branch 17, while end wall 26 includes a flow outlet 30 connected to the downstream section 31 of the pipe 17. The upstream pipe section 28 includes a ball circulating pump 20 which provides the flow necessary to divert the balls from the return pipe 14 at the ball strainer 18 and eject them into the main supply line 13 for circulation through the heat exchanger. Housing 23 also includes a dividing wall 32 which separates the housing 23 into an inlet chamber 34 in communication with inlet 27 and a collection chamber 36 in communication with outlet 30. New balls may also be, introduced through a removable access port **34*a* at the top of inlet chamber 34 while different types of balls such as abrasive bails may be introduced from a removable access port 36*a* at the top of collection chamber 36. Spaced from and located parallel to the dividing wall is a partition 33 terminating short of the bottom of housing 23 to form a channel 33*a* for guiding balls. Balls introduced from the system into inlet chamber 34 via inlet 27 are directed through guide channel 33*a* to a conditioning and sorting chamber 37 having a roller arrangement 38 mounted in a housing extension 40 bolted at the top of housing 23. Guide channel 33*a* has an opening 33*b* at the top thereof for receiving new aerated balls introduced from the port 34*a* at the top of chamber 34. Roller arrangement 38 comprises a pair of elongated rollers 42, 44, each of which has a uniformly sized squeezing portion 46 and a tapering portion 48 which gradually tapers away from the squeezing portion 46. Each of the rollers 42, 44 rotates on a respective shaft 42*a*, 44*a* and has a meshing gear wheel 50, 52 attached thereto such that a sprocket 54 on roller 44 connected via drive belt 56 to a sprocket 58 on an actuating motor 60 will turn and provide counterrotating movement to rollers 42, 44. As will be appreciated hereafter, conditioning and sorting chamber 37 includes a curved diverter channel 62 for guiding the path of the balls to a tapering gap 48*a* between the tapering portions 48 of the rollers 42, 44. Diverter channel 62 is provided with holes 62*a* to maintain a gradual waterflow therethrough that gently keeps the balls riding downwardly into the tapering gap 48 between rollers 42, 44**.

Figure 4:
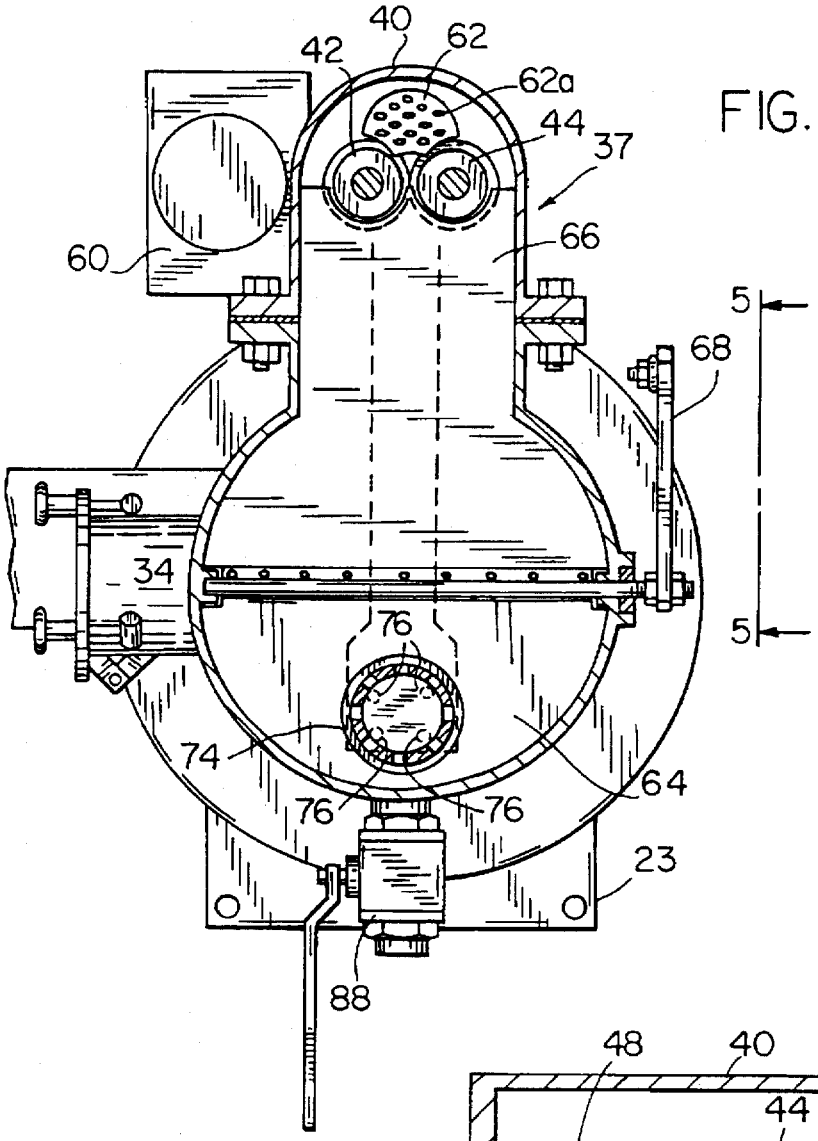
FIG. 4 is a cross-sectional view taken on line 4—4 of FIG. 3.
Figure 5:
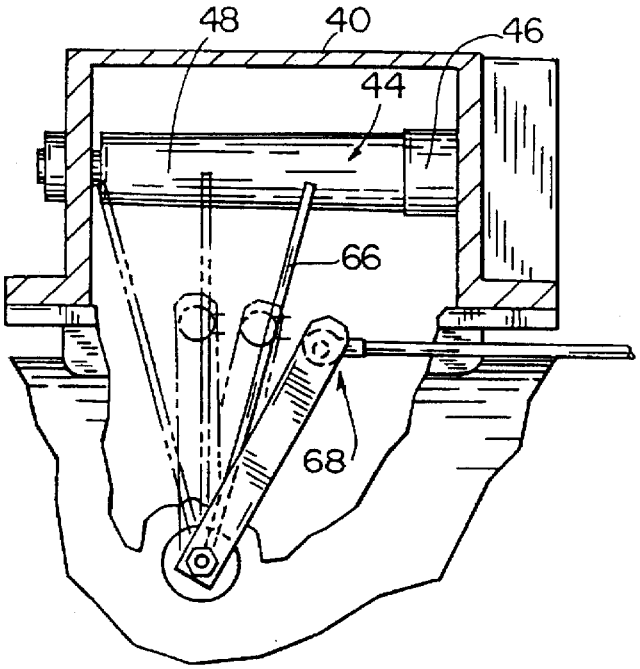
FIG. 5 is a cross-sectional view taken on line 5—5 of FIG. 4.
Figure 7:
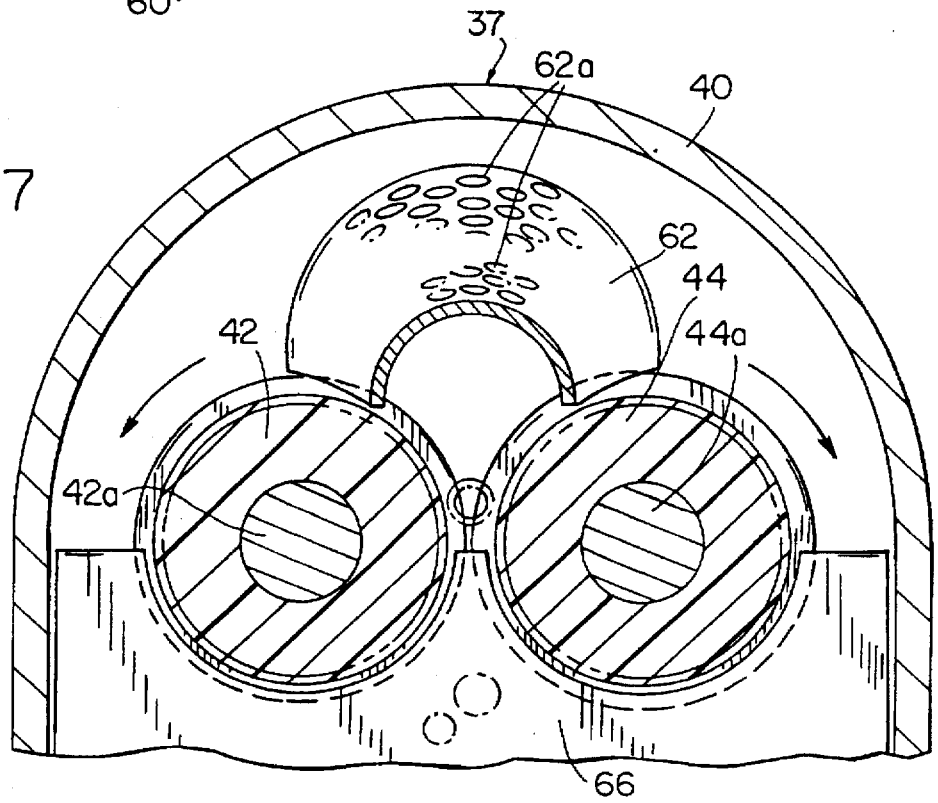
FIG. 7 is a cross-sectional view taken on line 7—7 of FIG. 6.

Inside collection chamber 36, a fixed planar plate 64 extends across the width of housing 23 and provides a base for a movable planar plate 66 which is pivotally mounted to the top of fixed plate 64 along an axis extending across the width of housing 23. As best seen in FIGS. 4 and 7, the upper portion of movable plate 66 conforms to the shape of rollers 42, 44 and is movable along the underside thereof over a predetermined distance controlled by an actuating lever assembly 68 (FIG. 5) accessible outside of housing 23. Fixed plate 64 and movable plate 66 together further divide collection chamber 36 into a rejected ball chamber 70 for collecting and holding damaged, worn or otherwise undesirable balls and an acceptable ball chamber 72 for collecting and holding new, properly sized or otherwise desirable balls. At the bottom of collection chamber 36, a movable cylindrical screen 74 is slidable along an axis parallel to the longitudinal centerline of housing 23 and through a small gap 75 in fixed plate 64. A set of longitudinally-extending guide rods 76 is welded circumferentially to the inside of screen 74 adjacent outlet 30. Rods 76 pilot into the outlet pipe and define a sliding bearing surface as screen 74 moves relative to end wall 26. One end of movable cylindrical screen 74 has an opening 78 closed against end wall 26 to prevent balls in acceptable ball chamber 72 from flowing back into the system. The other end of movable cylindrical screen 74 is connected to a linkage 80 which in turn is joined to an actuator 82 providing a stimulus for moving cylindrical screen 74 back and forth. With this structure, cylindrical screen 74 will continuously allow water from inlet 27 to flow therethrough and into outlet 30. However, cylindrical screen 74 also acts as a valve selectively opening and closing opening 78 against end wall 26 to control the flow of balls from acceptable ball chamber 72 back into the system through outlet 30. The small gap 75 in plate 64 accommodates the swinging movement of the screen 74 caused by linkage 80. A sight glass 84 (FIG. 2) extends from rejected ball chamber 70 to enable the monitoring of rejected balls collected therein. Balls in rejected ball chamber 70 may be drained by gravity into a convenient rejected ball container 86 (FIG. 1) by opening rejected ball drain valve 88. Balls in acceptable ball chamber 72 may be drained by gravity into a convenient acceptable ball container 90 by opening acceptable ball drain valve 92.

Figures 3, 8:
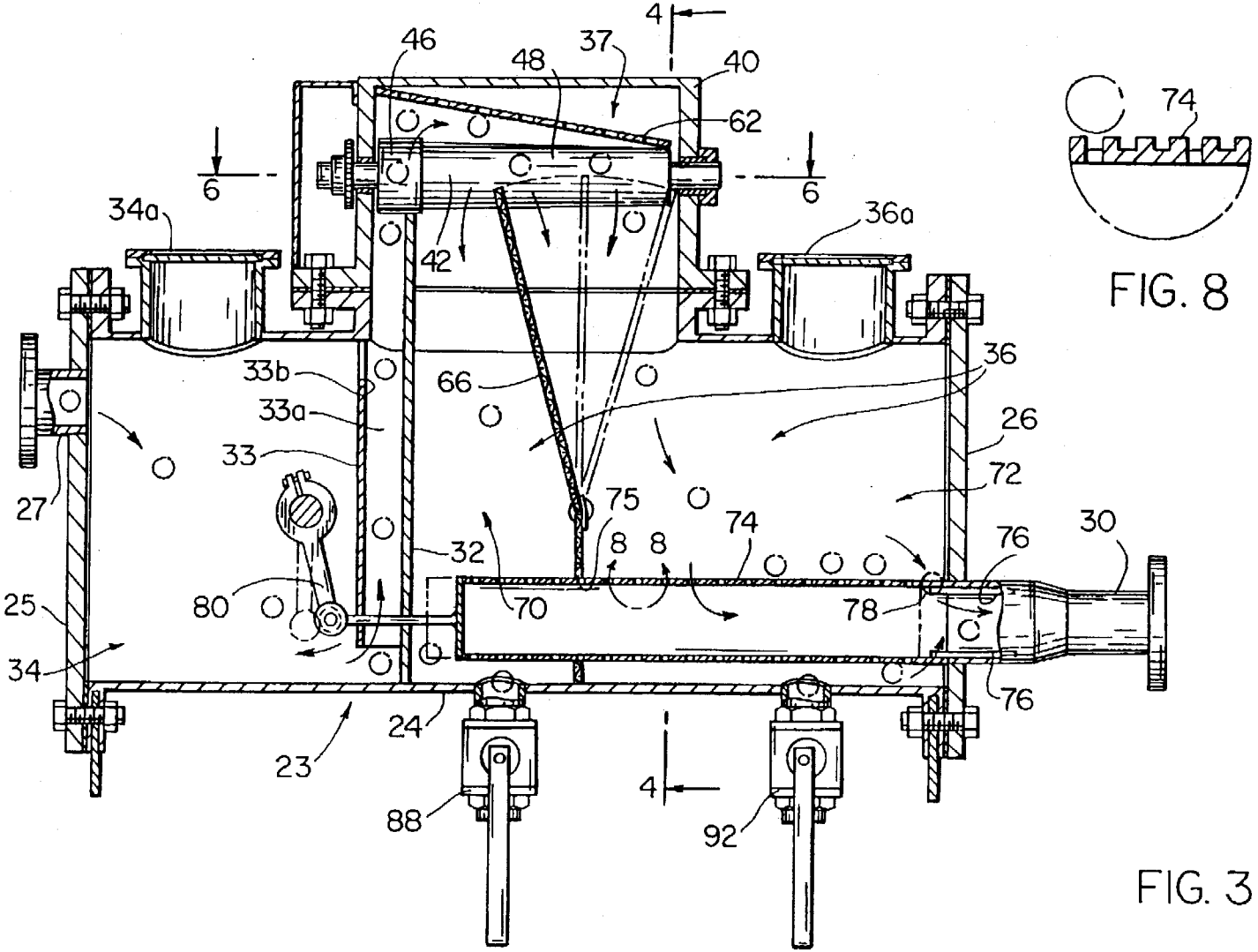
FIG. 3 is an enlarged sectional view of FIG. 2.
FIG. 8 is a cross-sectional view taken on line 8—8 of FIG. 3.
Figure 6:
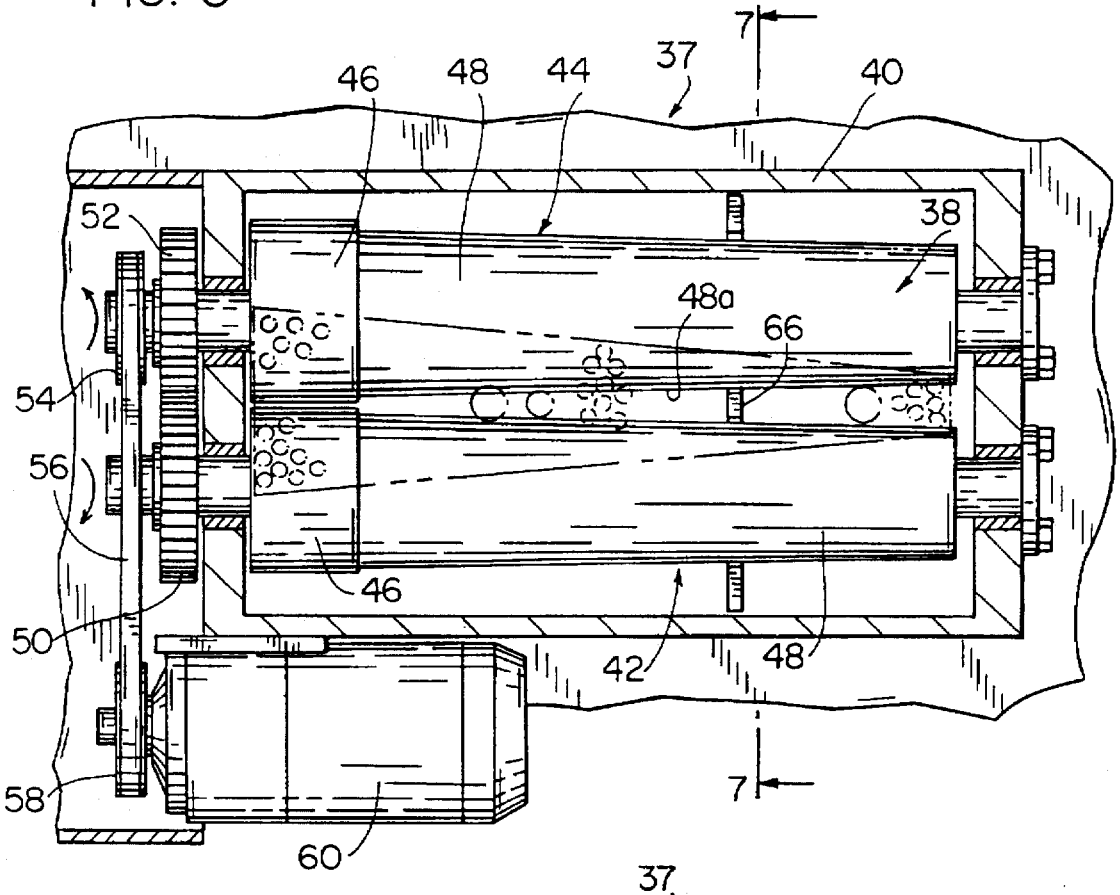
FIG. 6 is a cross-sectional view taken on line 6—6 of FIG. 3.

Referring now to FIGS. 3, 6, and 7, any new balls introduced from port 34*a* and each of the balls circulating in the system are fluid fed into inlet chamber 34 and guide channel 33*a* for delivery between the squeezing portions 46 of rollers 42, 44 where the balls are conditioned by de-aeration. Next, the de-aerated balls are sorted by guiding them from diverter channel 62 to tapered gap 48*a* (FIG. 6) between rollers 42, 44 which are designed such that worn or damaged balls having a decreased diameter will pass through the narrowest portion of gap 48*a* while new or undamaged balls having a greater diameter will pass through the wider portion of gap 48*a*. As seen in FIG. 7, the water carrying the balls upwardly through channel 33*a* flows upwardly between rollers 42, 44 as well as around the rollers 42, 44 along the inner periphery of housing extension 40. Water directed to the top of housing extension 40 then falls through the holes 62*a* in diverter channel 62 to maintain a downward migration of the balls into gap 48*a*. When it is desired to temporarily collect balls, as for backwashing ball strainer screen 22, movable plate 66 is positioned such that balls passing to the left of plate 66 will be collected in rejected ball chamber 70 and balls passing to the right of plate 66 will be collected in acceptable ball chamber 72. Balls in rejected ball chamber 70 can be monitored through sight glass 84 and can be periodically removed through drain valve 88. Balls are held in acceptable ball chamber 72 until opening 78 on cylindrical screen is uncovered, at which time ball strainer screen 22 has been backwashed and acceptable balls are allowed to flow back into system via outlet 30. If it is desired to remove or inspect some or all of balls in chamber 72, drain valve 92 is employed.

It should now be appreciated that the present invention provides an improved ball collection system in which balls are internally conditioned or de-aerated and in which de-aerated balls are selectively classified into rejected or acceptable balls. The invention is particularly versatile in providing introduction of new and different types of balls and removal of acceptable and/or rejected balls, if and when desired. Unlike the prior art, there is no need to normally de-aerate the balls external to the system or to use a vacuum arrangement as previously described. In addition, the present invention improves over prior art systems which are incapable of sorting balls into acceptable and rejected categories. With the structure of the present invention, it can be understood that control of acceptable balls in the system is markedly enhanced so that maintenance and down time is reduced and overall cleaning is substantially improved.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

We claim:

1. In a pipe cleaning system wherein porous, resilient, foam rubber balls are circulated in a flow of water through pipes to be cleaned, an apparatus for selectively recirculating, conditioning, sorting and collecting the balls and discharging balls from the system, the apparatus comprising:

housing means divided into inlet chamber means for introducing balls from the system and collection chamber means downstream of said inlet chamber means;

ball conditioning and sorting means operably connected with said housing means for de-aerating the balls from said inlet chamber means and selectively classifying the de-aerated balls within said collection chamber means; and valve means in said collection chamber means for permitting the continuous flow of water therethrough and selectively controlling the discharge of balls from said collection chamber into said system.

2. The apparatus of claim 1, wherein said housing means has a cylindrical outer wall and opposite end walls disposed in said inlet chamber means and said collection chamber means.

3. The apparatus of claim 1, wherein said inlet chamber means includes an inlet means for introducing balls recirculating in the system and first access port means for introducing balls from outside the system.

4. The apparatus of claim 1, wherein said collection chamber means is divided by a movable plate into an acceptable ball chamber and a rejected ball chamber.

5. The apparatus of claim 1, wherein said ball conditioning and sorting means comprises a pair of counterrotating roller means for receiving balls from said inlet chamber means, for squeezing air from the balls received from said inlet chamber means and for transporting the de-aerated balls along a path over which the balls are distributed by size.

6. The apparatus of claim 1, wherein said valve means comprises a movable cylindrical screen means having an aperture normally disposed in sealing relationship with said end wall of said collection chamber means to prevent balls in said collection chamber means from flowing therethrough and shiftable away from said end wall of said collection chamber means to permit balls in said collection chamber means to flow back into the system.

7. The apparatus of claim 1, wherein said collection chamber means includes second access port means for further introducing balls from outside the system.

8. The apparatus of claim 1, including drain valve means disposed in said collection chamber means for further controlling the discharge of balls from said collection chamber means into the system.

9. In a pipe cleaning system wherein porous, resilient foam rubber balls are circulated in a flow of water through pipes to be cleaned, an apparatus for selectively recirculating, conditioning, sorting and collecting the balls and discharging the balls from the system, the apparatus comprising:

a housing having a dividing wall defining an inlet chamber on one side thereof and a collection chamber on the other side thereof, said inlet chamber having an inlet and said collection chamber having an outlet, and a movable plate further dividing said collection chamber into a variably sized rejected ball chamber and a variably sized acceptable ball chamber;

a roller arrangement operably connected with said housing and cooperative with said movable plate to condition and sort the balls in the system into said rejected ball chamber and said acceptable ball chamber; and said collection chamber having a movable screen selectively controlling the flow of balls from said acceptable ball chamber to said outlet.

10. The apparatus of claim 9, wherein said movable plate is pivotally mounted on an axis extending across the width of said housing.

11. The apparatus of claim 9, wherein said roller arrangement is comprised of a pair of elongated, counterrotating rollers, each having a uniformly sized, ball squeezing portion and a gradually tapering ball sizing portion.

12. The apparatus of claim 9, including a first actuating arrangement for moving said movable plate.

13. The apparatus of claim 9, including a second actuating arrangement for moving said movable screen.

14. The apparatus of claim 9, including a third actuating arrangement for turning said roller arrangement.

15. The apparatus of claim 9, including a worn ball drain valve disposed in said rejected ball chamber and a acceptable ball drain valve disposed in said good ball chamber.

16. The apparatus of claim 9, including a sight glass extending from said rejected ball chamber.

17. The apparatus of claim 9, including a fixed plate disposed in said collection chamber and having said movable plate pivotally mounted thereon.

18. The apparatus of claim 17, wherein said movable screen is disposed at the bottom of said collection chamber for sealing, sliding movement through said fixed plate.

19. The apparatus of claim 9, wherein said movable screen is slidably movable along an axis parallel to the longitudinal axis of said housing.

20. The apparatus of claim 9, wherein said movable plate is engageable along substantially the entire length of said roller arrangement.

* * * * *